US011209854B2

(12) United States Patent
Zhou et al.

(10) Patent No.: US 11,209,854 B2
(45) Date of Patent: Dec. 28, 2021

(54) CONSTANT CURRENT DRIVING CIRCUIT AND CORRESPONDING PHOTOELECTRIC SMOKE ALARM CIRCUIT

(71) Applicant: CRM ICBG (WUXI) CO., LTD., Jiangsu (CN)

(72) Inventors: Yujie Zhou, Jiangsu (CN); Jieqiong Zneg, Jiangsu (CN); Tianshun Zhang, Jiangsu (CN); Zengwei Ding, Jiangsu (CN)

(73) Assignee: CRM ICBG (WUXI) CO., LTD., Jiangsu (CN)

( * ) Notice: Subject to any disclaimer, the term of this patent is extended or adjusted under 35 U.S.C. 154(b) by 0 days.

(21) Appl. No.: 17/257,213

(22) PCT Filed: Sep. 9, 2019

(86) PCT No.: PCT/CN2019/104885
§ 371 (c)(1),
(2) Date: Dec. 30, 2020

(87) PCT Pub. No.: WO2020/048544
PCT Pub. Date: Mar. 12, 2020

(65) Prior Publication Data

US 2021/0208619 A1 Jul. 8, 2021

(30) Foreign Application Priority Data

Sep. 7, 2018 (CN) ..... 201811041244.9

(51) Int. Cl.
*G05F 3/26* (2006.01)
*G08B 17/103* (2006.01)

(52) U.S. Cl.
CPC ..... *G05F 3/262* (2013.01); *G08B 17/103* (2013.01)

(58) Field of Classification Search
CPC ..... G05F 3/00; G05F 3/24; G05F 3/26; G05F 3/262; G05F 1/10; G05F 1/468;
(Continued)

(56) References Cited

U.S. PATENT DOCUMENTS 6,756,738 B2 * 6/2004 Maede ..... G09G 3/3216 315/169.1
9,081,398 B2 * 7/2015 Kujala ..... H02M 3/155
(Continued)

FOREIGN PATENT DOCUMENTS

CN 101105699 A 1/2008
CN 101226412 A 7/2008
(Continued)

OTHER PUBLICATIONS

NPL_search (Sep. 28, 2021).*
(Continued)

*Primary Examiner* — Nan T Trieu
(74) *Attorney, Agent, or Firm* — Tarolli, Sundheim, Covell & Tummino LLP

(57) ABSTRACT

A constant current driving circuit and a corresponding photoelectric smoke alarm circuit are provided. The constant current driving circuit includes a reference voltage source module (1), a linear voltage regulator module (3), a level conversion module (2), a current mirror module (4) and a first NMOS transistor. The linear voltage regulator module (3) may control turning on and turning off thereof according to actual requirements, thus electrical energy loss may effectively be reduced for some periodically used devices. The constant current driving circuit and the corresponding photoelectric smoke alarm circuit may provide a constant current source, so that auxiliary output performance remains stable within a full temperature range, a certain timing sequence requirement is met, no standby power is consumed
(Continued)

when not working, performance is stable, power consumption is low, and application range is wide.

20 Claims, 5 Drawing Sheets

(58) Field of Classification Search
CPC ..... G08B 17/10; G08B 17/103; G09G 3/10; G11C 5/00; G11C 5/14; G11C 5/147
See application file for complete search history.

(56) References Cited

U.S. PATENT DOCUMENTS

| | | | | |
|---|---|---|---|---|
| 10,678,283 | B2 * | 6/2020 | Sanasi | G11C 5/147 |
| 2006/0202745 | A1 * | 9/2006 | Kobayashi | G05F 3/24 327/541 |

FOREIGN PATENT DOCUMENTS

| | | | |
|---|---|---|---|
| CN | 100578587 | C | 1/2010 |
| CN | 101816119 | A | 8/2010 |
| CN | 203773395 | U | 8/2014 |
| CN | 204883456 | U | 12/2015 |
| CN | 106502301 | A | 3/2017 |
| CN | 106647923 | A | 5/2017 |
| CN | 108122363 | A | 6/2018 |
| CN | 109062317 | A | 12/2018 |
| WO | 2004042782 | A2 | 5/2004 |
| WO | 2004063827 | A1 | 7/2004 |

OTHER PUBLICATIONS

International Search Report dated Nov. 27, 2019 for corresponding International Application No. PCT/CN2019/104885.
Chinese Office Action dated Sep. 27, 2019 for corresponding CN application No. 201811041244.9, and English translation thereof.

* cited by examiner

CONSTANT CURRENT DRIVING CIRCUIT AND CORRESPONDING PHOTOELECTRIC SMOKE ALARM CIRCUIT

RELATED APPLICATIONS

The present application is a U.S. National Stage application under 35 USC 371 of PCT Application Serial No. PCT/CN2019/104885, filed on 9 Sep. 2019; which claims priority from CN Patent Application No. 201811041244.9, filed 7 Sep. 2018, the entirety of both of which are incorporated herein by reference.

TECHNICAL FIELD

The present disclosure relates to the field of circuit technologies, especially relates to a driving circuit, and particularly relates to a constant current driving circuit and a corresponding photoelectric smoke alarm circuit.

BACKGROUND

In some electronic devices, it is often necessary to ensure that when power is supplied to a specific load, a current flowing through the load may be kept constant within a certain variation range of a power supply voltage, and when power is supplied to a load with characteristics that may change with variation of ambient temperature, it is necessary to ensure that output characteristics of the load must be consistent over a full temperature range.

For example, in the field of smoke alarms, there are requirements regarding whether to provide a constant current. Smoke alarms may be classified into ionic smoke alarms and photoelectric smoke alarms. There is an optical labyrinth in the photoelectric smoke alarm, a structure of which is shown in FIG. 1. A working principle of the optical labyrinth is as follows. A constant current $I_1$ that does not vary with the power supply voltage, temperature and time is provided to the infrared light emitting diode $D_1$. The constant current $I_1$ flows in from a first port 1 in FIG. 1 and flows out from the second port 2, thereby generating infrared light with constant luminous efficiency. When there is no smoke, a photodiode $D_2$ may not receive the infrared light emitted by the infrared light emitting diode $D_1$. When smoke enters into the optical labyrinth, the photodiode $D_2$ receives the infrared light by refraction and reflection, thereby generating a photocurrent $I_0$. The photocurrent $I_0$ flows in from a fourth port 4 and flows out from a third port 3. The photocurrent $I_0$ is amplified, converted and quantified, and finally judged by the alarm circuit to determine whether it exceeds an alarm threshold and decide whether to issue an alarm. In order to ensure correct operation of the photoelectric smoke alarm, it is necessary to firstly ensure that the current flowing through the infrared light emitting diode $D_1$ remains constant within a certain variation range of the power supply voltage. In addition, since luminous efficiency of the infrared light emitting diode $D_1$ may decrease as temperature rises, luminous intensity of the infrared light emitting diode must be consistent over the full temperature range. With popularization of CMOS technology, the product of smoke alarms and chips have also developed towards a trend of low power consumption. The power supply voltage of the smoke alarm is supplied from a 9V battery to a 3V battery. Therefore, stricter requirements on the voltage coefficient of the constant current infrared light emitting module in the smoke alarm are proposed.

In the related art, there are mainly three types of mainstream constant current driving circuits, i.e., constant current driving circuits that use "single chip machine+discrete device", constant current driving circuits that use "built-out linear voltage regulators", and constant current driving circuits that use "built-in DC-DC boost voltage modules".

In the photoelectric smoke alarm circuit driven by constant current with "single-chip machine+discrete device", the final emission current of the infrared light emitting diode is still associated to the power supply voltage of the chip. Meanwhile, it is necessary to add peripherals on the PCB board, which may occupy a large area.

In the photoelectric smoke alarm circuit driven by constant current with "built-out linear voltage regulators", a voltage of the chip and an anode of the infrared light emitting diode are maintained stable, and there is no voltage coefficient. But this method has following disadvantages.

1. The constant current infrared light emitting diode emits once every 8 seconds, and duration is 100 μs to 200 μs. Power consumption of the smoke alarm is only about 5 μA most of time. Static power consumption of the selected linear voltage regulator is required to be very small and thus cost is high.

2. When the smoke alarm is required to detect battery power, an additional resistor string voltage divider must be provided at a positive electrode of the battery, which may increase the static power consumption and increase the cost.

In the photoelectric smoke alarm circuit driven by constant current with "built-in DC-DC boost voltage modules" has following disadvantages. The internal integrated DC-DC boost voltage modules need a larger area, and switching frequency is high. The PCB layout is required to consider EMI effect (electromagnetic interference effect).

SUMMARY

In order to overcome at least one of the above-mentioned disadvantages of the related art, the present disclosure aims to provide a constant current driving circuit and corresponding photoelectric smoke alarm circuit with a simple structure and no voltage coefficient of the constant generation circuit within a certain power supply voltage range, thereby ensuring that the load may maintain consistent output characteristics over the full temperature range.

In order to achieve the above object, the constant current driving circuit and the corresponding photoelectric smoke alarm circuit according to the present disclosure include the following configuration.

A main feature of the constant current driving circuit is that the constant current driving circuit includes a reference voltage source module; a linear voltage regulator module; a level conversion module; a current mirror module; and a first NMOS transistor, wherein an input terminal of the reference voltage source module and a second input terminal of the linear voltage regulator module are each connected with an external power supply; an output terminal of the reference voltage source module is connected with a first input terminal of the linear voltage regulator module and an input terminal of the level conversion module; an output terminal of the linear voltage regulator module is connected with a power terminal of the level conversion module and a power terminal of the current mirror module, and then used as an output terminal of the constant current driving circuit; an output terminal of the level conversion module is connected with an input terminal of the current mirror module; and an output terminal of the current mirror module is connected with a gate electrode of the first NMOS transistor, a source electrode of the first NMOS transistor is grounded, and a drain electrode of the first NMOS transistor is used as an input terminal of the constant current driving circuit.

Preferably, the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

A main feature of the photoelectric smoke alarm circuit including the constant current driving circuit is that the photoelectric smoke alarm circuit further includes a capacitor and an optical labyrinth module; the optical labyrinth module includes an infrared light emitting diode and a photodiode; the capacitor and the infrared light emitting diode are jointly used as a load; one terminal of the capacitor and an anode of the infrared light emitting diode are jointly used as a first port of the load and are each connected with the output terminal of the constant current driving circuit; the other terminal of the capacitor is grounded; a cathode of the infrared light emitting diode is used as a second port of the load and is connected with the drain electrode of the first NMOS transistor; and the photodiode is driven by the infrared light emitting diode to work.

In the constant current driving circuit, turning on and turning off of the linear voltage regulator module may be separately controlled. For some periodically operated devices, electric energy loss may be effectively reduced. The reference voltage source module, the linear voltage regulator module, the level conversion module, the current mirror module and the first NMOS transistor may be integrated into a same chip, so that the constant current driving circuit has a more compact structure and occupied area of PCB is reduced. There is no voltage coefficient within a certain power supply voltage range. It may meet requirements on a certain timing sequence, and there is no standby power consumption when not working. In the photoelectric smoke alarm circuit including the constant current driving circuit, the temperature coefficient generated by constant current and the temperature coefficient of the infrared light emitting diode are partially offset, so that the current flowing through the infrared light emitting diode remains constant within a certain variation range of power supply voltage, and the luminous intensity of infrared light emitting diodes remains consistent over the full temperature range.

DESCRIPTION OF EMBODIMENTS

In order to describe technical contents of the present disclosure more clearly, further description will be given below in conjunction with specific embodiments.

With a constant current driving circuit and a corresponding photoelectric smoke alarm circuit provided in the present disclosure, the constant current driving circuit may keep the current flowing through the load constant within a certain variation range of power supply voltage, and may ensure that output characteristics of the load remain consistent over the full temperature range. Meanwhile, the constant current driving circuit has no voltage coefficient within a certain power supply voltage range, thereby meeting certain timing sequence requirements, and having no standby power consumption when not working.

Figure 1:
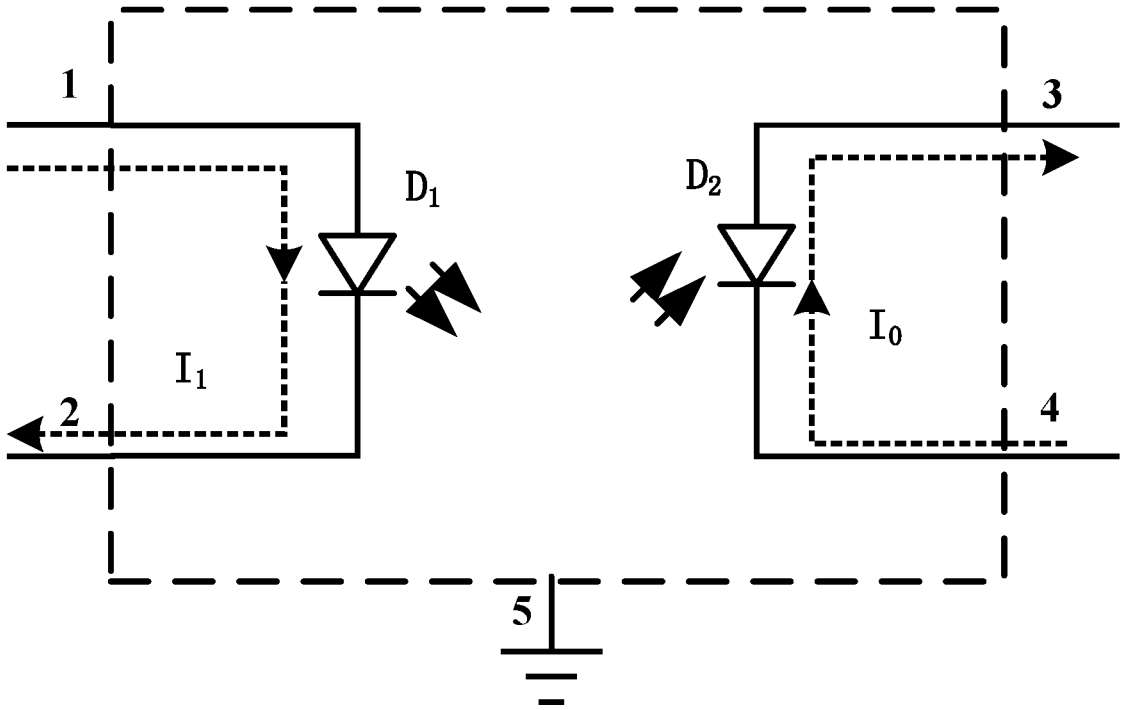
FIG. 1 is a principle diagram of an optical labyrinth.
Figure 2:
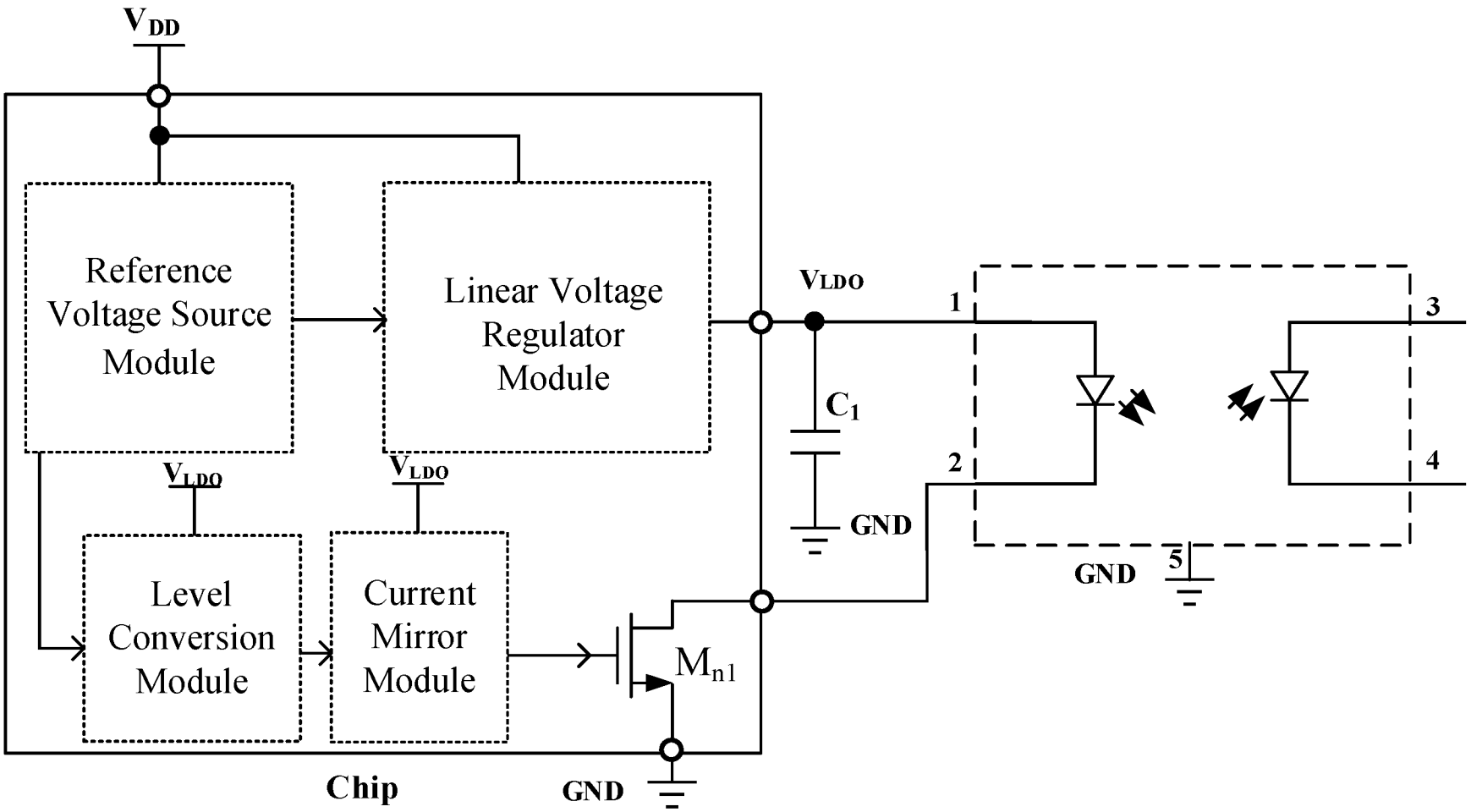
FIG. 2 is a schematic diagram showing functional modules of a photoelectric smoke alarm circuit with a constant current driving circuit according to an embodiment of the present disclosure.

Referring to FIG. 2, FIG. 2 is a schematic diagram showing functional modules of a photoelectric smoke alarm circuit with a constant current driving circuit according to an embodiment of the present disclosure. The photoelectric smoke alarm circuit includes a capacitor $C_1$, an optical labyrinth module and a constant current driving circuit.

The optical labyrinth module includes an infrared light emitting diode $D_1$ and a photodiode $D_2$.

The capacitor $C_1$ and the infrared light emitting diode $D_1$ are jointly used as a load.

One terminal of the capacitor $C_1$ and an anode of the infrared light emitting diode $D_1$ are jointly used as a first port of the load, and are each connected with an output terminal of the constant current driving circuit.

The other terminal of the capacitor $C_1$ is grounded.

A cathode of the infrared light emitting diode $D_1$ is used as a second port of the load and is connected with a drain electrode of a first NMOS transistor $M_{n1}$.

The photodiode $D_2$ is driven by the infrared light emitting diode $D_1$ to work. The optical labyrinth is the same as that in the photoelectric smoke alarm in the related art. That is, when the infrared light emitting diode $D_1$ emits light, the photodiode $D_2$ generates a photocurrent.

The constant current driving circuit includes a reference voltage source module 1, a linear voltage regulator module 3, a level conversion module 2, a current mirror module 4 and the first NMOS transistor $M_{n1}$.

The functions of each module are described as follows.

The reference voltage source module 1 is configured to provide a band gap reference voltage $V_{REF}$ to the level conversion module 2.

The linear voltage regulator module 3 provides a stable power supply voltage that does not change with an external power supply $V_{DD}$ to the level conversion module 2 and the current mirror module 4, and is also used as the power supply voltage of the infrared light emitting diode $D_1$.

In the level conversion module 2, since power supplies of the reference voltage source module 1 and the current mirror module 4 are different, a bias voltage (i.e., the band gap reference voltage $V_{REF}$) generated in the reference voltage source module 1 may not be directly provided to the current mirror module 4. The level conversion module 2 serves to convert the band gap reference voltage $V_{REF}$ provided by the reference voltage source module 1 so as to regenerate a bias voltage matching the current mirror module 4. A temperature coefficient of the regenerated bias voltage must be associated with a temperature coefficient of the original reference bias voltage (referring to the band gap reference voltage $V_{REF}$ generated by the reference voltage source module 1).

The current mirror module 4 is configured to replicate the bias current multiple times and finally transmit to the open-drain transistor (i.e., the first NMOS transistor $M_{n1}$) to generate a current. Meanwhile, the current mirror module 4 is configured to ensure that a gate-source voltage $V_{GS}$ and a source-drain voltage VDS of the open-drain transistor (i.e., the first NMOS transistor $M_{n1}$) remain unchanged and an emission current of the infrared light emitting diode $D_1$ may thus be kept constant.

A connection relationship of the modules is as follows.

An input terminal of the reference voltage source module 1 and a second input terminal of the linear voltage regulator module 3 are each connected with the external power supply $V_{DD}$.

An output terminal of the reference voltage source module 1 is connected with a first input terminal of the linear voltage regulator module 3 and an input terminal of the level conversion module 2 simultaneously.

An output terminal of the linear voltage regulator module 3 is connected with a power terminal of the level conversion module 2 and a power terminal of the current mirror module 4 simultaneously and then used as an output terminal of the constant current driving circuit.

An output terminal of the level conversion module 2 is connected with an input terminal of the current mirror module 4.

An output terminal of the current mirror module 4 is connected with a gate electrode of the first NMOS transistor $M_{n1}$. A source electrode of the first NMOS transistor $M_{n1}$ is grounded, and a drain electrode of the first NMOS transistor $M_{n1}$ is used as an input terminal of the constant current driving circuit.

The external power supply has a constant reference voltage. The output terminal of the constant current driving circuit is connected with a first port of an external load. The input terminal of the constant current driving circuit is connected with a second port of the load.

In this embodiment, the reference voltage source module 1, the linear voltage regulator module 3, the level conversion module 2, the current mirror module 4 and the first NMOS transistor Mill are integrated in a chip. The input terminal of the reference voltage source module 1 and the second input terminal of the linear voltage regulator module 3 are jointly used as a power terminal of the chip. The source electrode of the first NMOS transistor Mill is used as a ground terminal of the chip. The output terminal of the linear voltage regulator module 3, the power terminal of the level conversion module and the power terminal of the current mirror module are jointly connected to be an output terminal of the chip. The drain electrode of the first NMOS transistor Mill is used as an input terminal of the chip. Since each module is located in the chip, occupied area of PCB is saved, so that the structure is more compact without additional external devices.

Compared to the related art, the manner of integrating all modules on a same chip makes the structure of the constant current driving circuit more compact, and may realize the purpose of separately controlling on and off of linear voltage regulator module 3, since the linear voltage regulator module 3 is also located in the chip. In the photoelectric smoke alarm circuit (it may also be other similar discontinuously operating circuits, which is not limited thereto), since the constant current driving circuit is not required to be a normally operating structure but is only periodically enabled, this manner of arranging the linear voltage regulator module 3 in the chip may better save energy consumption. However, in the related art, since the linear voltage regulator module 3 is located outside the chip, the linear voltage regulator module 3 is required to be normally operating, which may consumes a considerable amount of quiescent current.

In a smoke probe standard (GB20517), the entire chip needs to detect current battery power in the photoelectric smoke alarm. When the voltage is lower than a set voltage, the probe needs to generate a low-voltage alarm signal that is different from the smoke sound and light alarm. If the linear voltage regulator module 3 is provided external to the chip, the external linear voltage regulator module 3 keeps the entire chip at a certain level lower than the battery voltage so that the chip may not detect the current voltage of the battery and issue a low-voltage alarm signal.

Therefore, this technical solution in this embodiment may reduce battery power consumption, and have a low voltage detection function.

Figure 3:
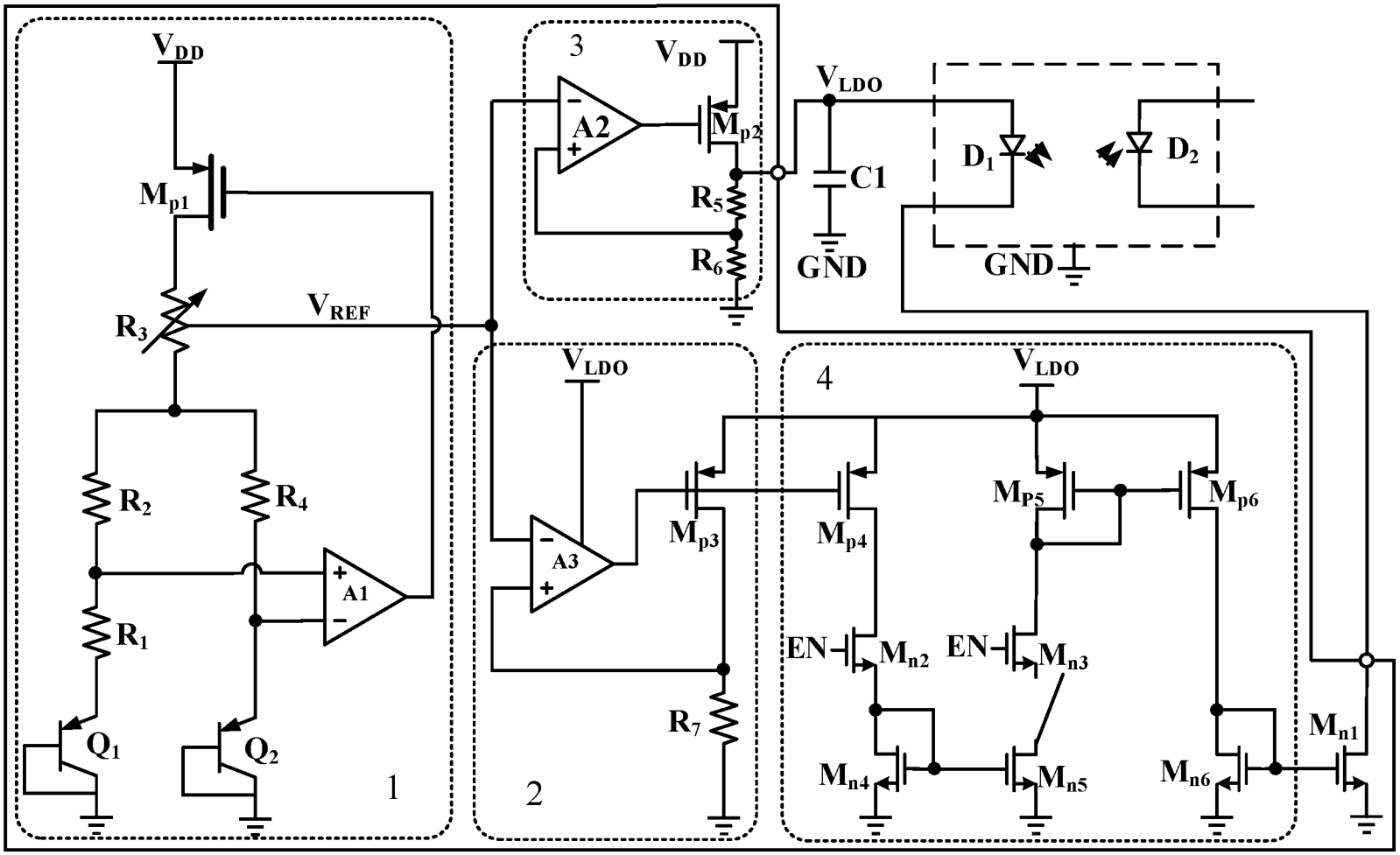
FIG. 3 is a structural schematic diagram showing a part of a photoelectric smoke alarm circuit with a constant current driving circuit according to an embodiment of the present disclosure.

As shown in FIG. 3, FIG. 3 is a partial structural schematic diagram showing a photoelectric smoke alarm circuit with a constant current driving circuit according to an embodiment of the present disclosure.

In this embodiment, the reference voltage source module 1 includes a first PMOS transistor $M_{p1}$, a first resistor $R_1$, a second resistor $R_2$, a third resistor $R_3$, a fourth resistor $R_4$, a first triode $Q_1$, a second triode $Q_2$ and a first amplifier A1. The third resistor $R_3$ is an adjustable resistor. The fourth resistor $R_4$ is a thermistor which has a negative temperature coefficient in this embodiment. In this embodiment, the first transistor $Q_1$ and the second transistor $Q_2$ are each a PNP-type triode.

A source electrode of the first PMOS transistor $M_{p1}$ is used as the input terminal of the reference voltage source module 1, and is connected with the external power supply. A drain electrode of the first PMOS transistor $M_{p1}$ is connected with a first terminal of the third resistor $R_3$. A second terminal of the third resistor $R_3$ is connected with the second resistor $R_2$ and the fourth resistor $R_4$ simultaneously.

The second resistor $R_2$ is connected in series with the first resistor $R_1$ and then connected with an emitting electrode of the first triode $Q_1$. A base electrode and collector electrode of the first transistor $Q_1$ are each grounded.

The fourth resistor $R_4$ is connected with an emitting electrode of the second triode $Q_2$. A base electrode and collector electrode of the second triode $Q_2$ are each grounded.

A non-inverting input terminal of the first amplifier A1 is connected between the second resistor $R_2$ and the first resistor $R_1$. An inverting input terminal of the first amplifier A1 is connected between the fourth resistor $R_4$ and the emitting electrode of the second triode $Q_2$. An output terminal of the first amplifier A1 is connected with a gate electrode of the first PMOS transistor $M_{p1}$.

An adjustable terminal of the third resistor $R_3$ is used as the output terminal of the reference voltage source module 1, and is connected with the first input terminal of the linear voltage regulator module 3 and the input terminal of the level conversion module 2 simultaneously.

In this embodiment, the reference voltage source module 1 uses a parasitic triode as $V_{BE}$, and uses negative feedback to cause a voltage at the non-inverting input terminal of the first amplifier A1 to be equal to a voltage at the inverting input terminal of the first amplifier A1. A $V_{BE}$ difference between the first triode and the second triode is divided by a resistance value of the first resistor to obtain a PTAT current (PTAT refers to "proportional to absolute temperature", and PTAT current refers to a current having a value directly proportional to the absolute temperature). The PTAT current flows through the third resistor $R_3$, and a reference voltage value is obtained. Their relationship meets following formula (1):

$$V_{REF} = V_{BE2} + \frac{R_2 + 2R_3}{R_1}\frac{KT}{q}\ln N. \quad (1)$$

In the formula, $V_{REF}$ denotes an output value of the band gap reference voltage, K denotes Boltzmann's constant, T denotes a thermodynamic temperature, i.e., absolute temperature of 300K, q denotes electronic charges, N denotes a proportional coefficient flowing the first triode $Q_1$ and the second triode $Q_2$, $V_{BE2}$ denotes a junction voltage between a base electrode and emitting electrode of the second transistor $Q_2$, $R_1$ denotes a resistance value of the first resistor $R_1$, $R_2$ denotes a resistance value of the second resistor $R_2$, and $R_3$ denotes a resistance value of the third resistor $R_3$.

In this embodiment, the linear voltage regulator module 3 includes a second amplifier A2, a second PMOS transistor $M_{p2}$, a fifth resistor $R_5$ and a sixth resistor $R_6$.

An inverting input terminal of the second amplifier A2 is used as a first input terminal of the linear voltage regulator module 3 and is connected with the output terminal of the reference voltage source module 1. An output terminal of the second amplifier A2 is connected with a gate electrode of the second PMOS transistor $M_{p2}$. A source electrode of the second PMOS transistor $M_{p2}$ is used as a second input terminal of the linear voltage regulator module 3, and is connected with the external power supply $V_{DD}$. A drain electrode of the second PMOS transistor $M_{p2}$ is connected with one terminal of the fifth resistor $R_5$, the other terminal of the fifth resistor $R_5$ is connected with one terminal of the sixth resistor $R_6$, and the other terminal of the sixth resistor $R_6$ is grounded.

A non-inverting input terminal of the second amplifier A2 is connected between the fifth resistor $R_5$ and the sixth resistor $R_6$.

A drain electrode of the second PMOS transistor $M_{p2}$ is used as the output terminal of the linear voltage regulator module 3 and is connected with the power terminal of the level conversion module 2 and the power terminal of the current mirror module 4 simultaneously.

The linear voltage regulator module 3 uses the constant band gap reference voltage $V_{REF}$ provided by the reference voltage source module 1 to obtain a constant voltage $V_{LDO}$ with load capacity by negative feedback of the second amplifier A2, the second PMOS transistor $M_{p2}$ and a resistor network (including the fifth resistor $R_5$ and the sixth resistor $R_6$), so as to supply the level conversion module 2 and the current mirror module 4 to work normally. A calculation expression of the voltage value of $V_{LDO}$ meets following formula (2):

$$V_{LDO} = \left(1 + \frac{R_5}{R_6}\right)V_{REF}. \quad (2)$$

In the formula, $V_{LDO}$ denotes a voltage value of the output voltage of the linear voltage regulator module 3, $V_{REF}$ denotes an output value of the band gap reference voltage, $R_5$ denotes a resistance value of the fifth resistor $R_5$, and $R_6$ is a resistance value of the sixth resistor R6.

In this embodiment, the level conversion module 2 includes a third amplifier A3, a third PMOS transistor $M_{p3}$, and a seventh resistor $R_7$.

An inverting input terminal of the third amplifier A3 is used as the input terminal of the level conversion module 2 and is connected with the output terminal of the reference voltage source module 1. An output terminal of the third amplifier A3 is connected with a gate electrode of the third PMOS transistor $M_{p3}$. A drain electrode of the third PMOS transistor $M_{p3}$ is connected with one terminal of the seventh resistor $R_7$, and the other terminal of the seventh resistor $R_7$ is grounded.

A non-inverting input terminal of the third amplifier A3 is connected between the drain electrode of the third PMOS transistor $M_{p3}$ and the seventh resistor $R_7$.

A power terminal of the third amplifier A3 and a source electrode of the third PMOS transistor $M_{p3}$ are jointly used as the power terminal of the level conversion module 2 and are connected with the output terminal of the linear voltage regulator module 3.

A gate electrode of the third PMOS transistor $M_{p3}$ is used as the output terminal of the level conversion module 2 and is connected with the input terminal of the current mirror module 4.

In the above embodiments, a functional effect of the level conversion module 2 is to stabilize the power supply of the entire constant current driving circuit (including the current mirror module 4) to a certain voltage value lower than the battery voltage, so that the battery voltage within a reduced certain range, the current provided to the infrared light emitting diode D1 may be maintained constant. Compared with the DC-DC boost voltage module in the related art, the level conversion module occupies a smaller chip area and does not need to occupy pin resources of the chip.

Its working principle is: the level conversion module 2 uses the constant band gap reference voltage $V_{REF}$ provided by the reference voltage source module 1, the third amplifier A3 forms a negative feedback loop, so that the non-inverting input terminal of the third amplifier A3 clamps the voltage of the seventh resistor $R_7$ to generate a constant current. Therefore, the voltage of the gate terminal of the third PMOS transistor $M_{p3}$, i.e., the voltage of the output terminal of the third amplifier A3, may remain unchanged, thereby providing a constant bias voltage for the current mirror module 4. The level conversion module is configured to convert the band gap reference voltage output by the reference voltage source module into a bias voltage matching the current mirror module. The temperature coefficient of the bias voltage is associated with the temperature coefficient of the band gap reference voltage. In other embodiments, the temperature coefficient of the bias voltage is associated with the temperature coefficient of the band gap reference voltage, and associated with the temperature coefficient of the seventh resistor $R_7$. In other embodiments, the temperature coefficient association means that the temperature coefficient of the regenerated bias voltage must be consistent with the temperature coefficient of the original reference bias voltage (band gap reference voltage).

In this embodiment, the current mirror module 4 includes a fourth PMOS transistor $M_{p4}$, a fifth PMOS transistor $M_{p5}$, a sixth PMOS transistor $M_{p6}$, a second NMOS transistor $M_{n2}$, a third NMOS transistor $M_{n3}$, a fourth NMOS transistor $M_{n4}$, a fifth NMOS transistor $M_{n5}$ and a sixth NMOS transistor $M_{n6}$.

A gate electrode of the fourth PMOS transistor $M_{p4}$ is used as the input terminal of the current mirror module 4 and is connected with the output terminal of the level conversion module 2.

A source electrode of the fourth PMOS transistor $M_{p4}$, a source electrode of the fifth PMOS transistor $M_{p5}$, and a source electrode of the sixth PMOS transistor $M_{p6}$ are jointly used as the power terminal of the current mirror module 4, and are each connected with the output terminal of the linear voltage regulator module 3.

A drain electrode of the fourth PMOS transistor $M_{p4}$ is connected with a drain electrode of the second NMOS transistor $M_{n2}$. A source electrode of the second NMOS transistor $M_{n2}$ is connected with a drain electrode of the fourth NMOS transistor $M_{n4}$, a gate electrode of the fourth NMOS transistor $M_{n4}$ and a gate electrode of the fifth NMOS transistor $M_{n5}$ simultaneously.

A drain electrode of the fifth PMOS transistor $M_{p5}$ is connected with a drain electrode of the third NMOS transistor $M_{n3}$. A source electrode of the third NMOS transistor $M_{n3}$ is connected with a drain electrode of the fifth NMOS transistor $M_{n5}$.

A gate electrode of the fifth PMOS transistor $M_{p5}$ is connected with a drain electrode of the fifth PMOS transistor $M_{p5}$ and a gate electrode of the sixth PMOS transistor $M_{p6}$ simultaneously.

A drain electrode of the sixth PMOS transistor $M_{p6}$ is connected with a drain electrode of the sixth NMOS transistor $M_{n6}$ and a gate electrode of the sixth NMOS transistor $M_{n6}$ simultaneously.

A gate electrode of the second NMOS transistor $M_{n2}$ and a gate electrode of the third NMOS transistor $M_{n3}$ are each connected with an enable signal.

A source electrode of the fourth NMOS transistor $M_{n4}$, a source electrode of the fifth NMOS transistor $M_{n5}$ and a source electrode of the sixth NMOS transistor $M_{n6}$ are each grounded.

A gate electrode of the sixth NMOS transistor $M_{n6}$ is used as the output terminal of the current mirror module 4 and is connected with the gate electrode of the first NMOS transistor $M_{n1}$.

In the current mirror module 4, a bias of the current mirror module 4 is connected with the output terminal of the third amplifier A3 in the level conversion module 2. After an EN signal (enable signal) is received, in the case that the respective MOS transistors (including the fourth PMOS transistor $M_{p4}$, the fifth PMOS transistor $M_{p5}$, the sixth PMOS transistor $M_{p6}$, the second NMOS transistor $M_{n2}$, the third NMOS transistor $M_{n3}$, the fourth NMOS transistor $M_{n4}$, the fifth NMOS transistor $M_{n5}$ and the sixth NMOS transistor $M_{n6}$) in the current mirror module 4 are each at a saturation region, a gate-source voltage obtained finally by open-drain transistors is kept constant through multiple current mirror replication without being affected by the power supply voltage.

When the constant current driving circuit is applied in the photoelectric smoke alarm circuit, the constant current driving circuit is connected with the optical labyrinth module and the capacitor $C_1$, and an anode of the infrared light emitting diode is connected with the output terminal of the linear voltage regulator module 3. In this way, it may be ensured that the obtained drain-source voltage VDS of the open-drain transistor (first NMOS transistor $M_{n1}$) is basically consistent under the same emission current.

Formula (3) below is obtained from an I-V characteristic curve of the MOS transistors:

$$I_{DS} = \frac{1}{2}\mu_N C_{ox}\frac{W}{L}(V_{GS} - V_{TH})^2(1 + \lambda V_{DS}). \tag{3}$$

In the formula, IDS denotes a source-drain current of the MOS transistor, $\mu_N$ denotes an electron migration rate, $C_{ox}$ denotes a thickness of a gate oxide, W denotes a channel width of the MOS transistor, L denotes a channel length of the MOS transistor, $V_{GS}$ denotes a gate-source voltage of the MOS transistor, $V_{TH}$ denotes a threshold voltage for turning on the MOS transistor, $\lambda$ denotes a channel length modulation factor of the MOS transistor, and VDS denotes a drain-source voltage of the MOS transistor.

It may be seen from the above formula that the current of the MOS transistor is associated with the gate-source voltage and the drain-source voltage simultaneously. It is known that the current of the first NMOS transistor $M_{n1}$ in this embodiment is associated with the gate-source voltage $V_{GS}$ and the drain-source voltage VDS simultaneously. If the gate-source voltage $V_{GS}$ and the drain-source voltage VDS may be maintained constant, the current may also be maintained constant. Therefore, in this embodiment, a constant gate-source voltage $V_{GS}$ is obtained by the current mirror module 4, and a constant drain-source voltage VDS is obtained by the linear voltage regulator module 3, and finally a constant current may be maintained within a large variation range of the power supply voltage.

Figure 4:
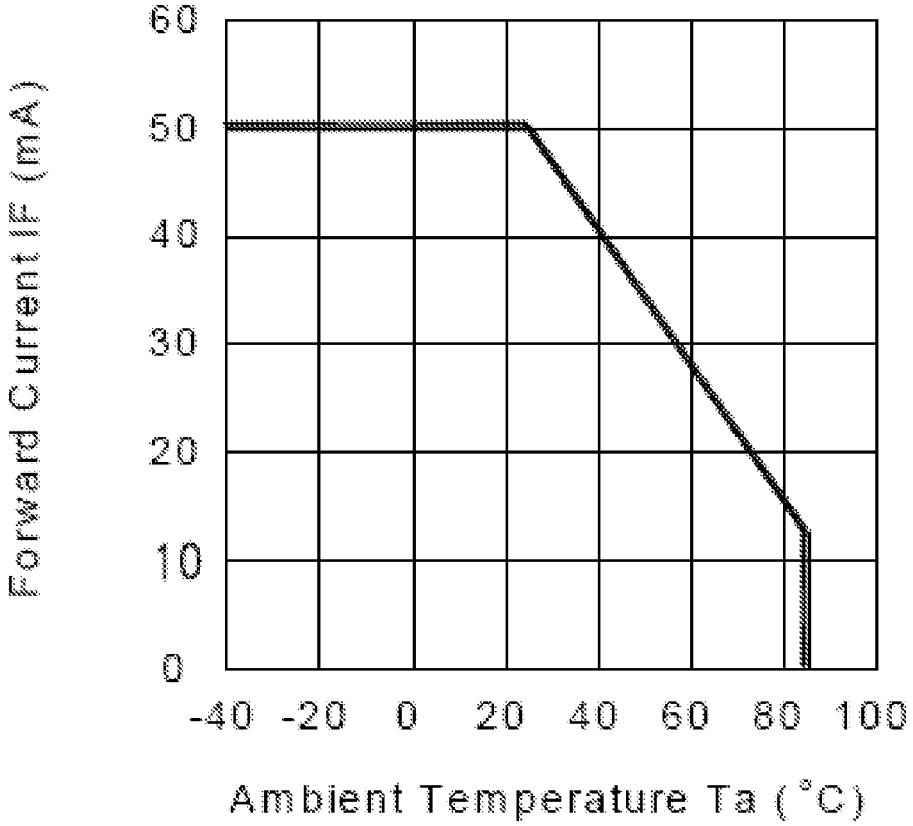
FIG. 4 is a temperature coefficient diagram of an infrared light emitting diode.

In this embodiment of the present disclosure, since luminous efficiency of the infrared light emitting diode may decrease as the temperature rises, temperature coefficient of the infrared emitting transistor in the optical labyrinth should be considered in addition to a stable current output. The characteristics of the temperature coefficient of the infrared light emitting diode D1 is shown in FIG. 4. FIG. 4 is a graph showing temperature coefficient of an infrared light emitting diode, in which a horizontal axis represents the ambient temperature with a unit of degree Celsius, and a vertical axis represents a forward current with a unit of milliamp. It may be seen from the drawing that the higher the temperature is, the smaller the emission current of the infrared light emitting diode will be. Therefore, it is necessary to compensate a certain emission current when the temperature is high, that is, the emission current must have a positive temperature coefficient. Therefore, in the present disclosure, the temperature coefficient of the constant reference voltage generated by the reference voltage source module 1 is required to be adjusted slightly positive. When the temperature rises, the current flowing through the fourth resistor $R_4$ becomes larger since the fourth resistor is a resistor having a negative temperature coefficient, and the gate voltage of the first PMOS transistor $M_{p1}$ becomes smaller, the emission current replicated to the output terminal of the first NMOS transistor $M_{n1}$ by the current mirror module 4 may have a positive temperature coefficient. That is, when the temperature rises, the resistance of the fourth resistor $R_4$ becomes smaller, and the reference voltage increases as the temperature rises. The constant band gap reference voltage $V_{REF}$ generated by the reference voltage source module 1 at this time is divided by the resistance value of the fourth resistor $R_4$ to obtain a bias current. The obtained bias current increases as the temperature rises.

Figure 5:
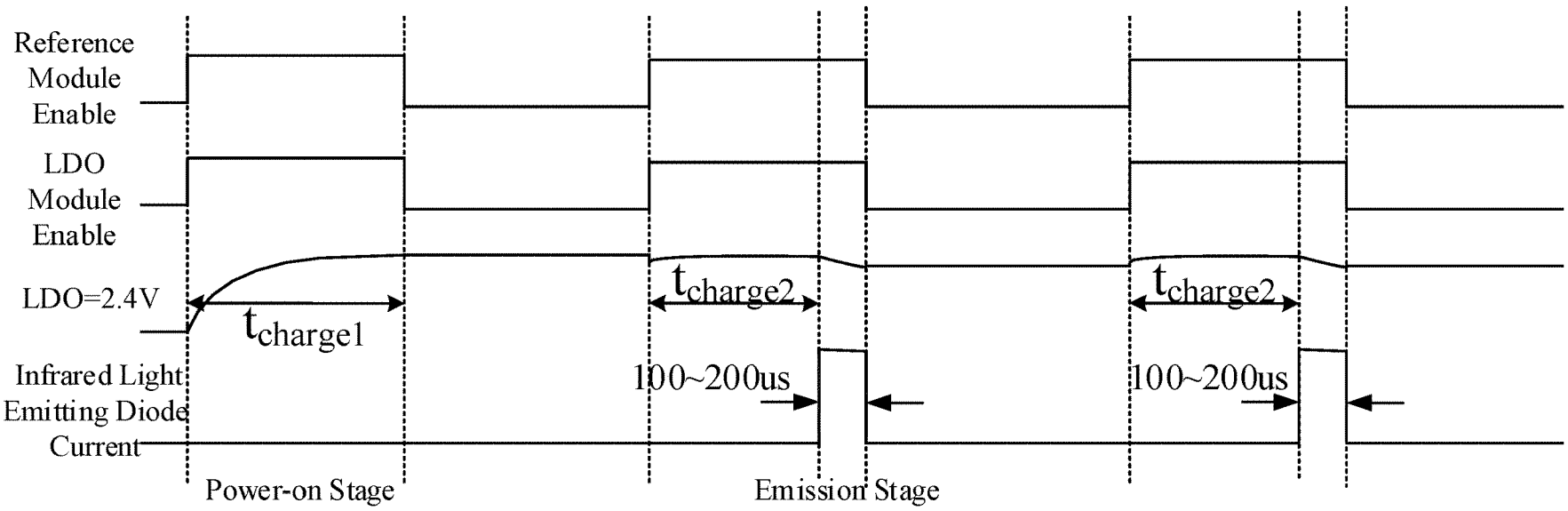
FIG. 5 is an application timing diagram of a photoelectric smoke alarm circuit with a constant current driving circuit.

In the embodiments of the present disclosure, the constant current driving circuit is applied in the photoelectric smoke alarm circuit, since the infrared light emitting diode in the photoelectric smoke alarm circuit may not work continuously for a long time and the standby power consumption is small, the above modules need to cooperate in application to meet requirements of certain timing sequence. The application timing sequence of the photoelectric smoke alarm circuit having a constant current driving circuit is shown in FIG. 5. It is known from the drawing that the radiation phase of the infrared light emitting diode $D_1$ only lasts for a while, and it does not work continuously. A waveform in a first row in the drawing is a waveform of the enable signal of the reference voltage source, a waveform in a second row is a waveform of the enable signal of the linear voltage regulator module 3, a waveform in a third row is a waveform of a voltage when the voltage of the LDO is 2.4V, for example, and a waveform in a fourth row is a current waveform of the infrared light emitting diode. It may be seen from the waveform of the fourth row that the low level is a power-on phase, and a high level is a radiation phase. In this figure, charging times $t_{charge1}$ and $t_{charge2}$ of the linear voltage regulator module 3 (LDO module) are associated with a maximum output load current capacity of the linear voltage regulator module 3 (LDO), and a capacitance value of the capacitor $C_1$. The larger the load current capacity is, the larger the capacitance value of the capacitor $C_1$ will be, and the smaller the drop voltage of the linear voltage regulator module 3 (LDO) will be, with longer charging time, which needs to be adjusted according to actual situations.

In the photoelectric smoke alarm circuit with a constant current driving circuit in the above embodiments, the constant current driving circuit is integrated in a chip, and the constant current generation circuit has no voltage coefficient within a certain power supply voltage range (the power supply voltage range may be adjusted by adjusting a ratio of the fifth resistor $R_5$ to the sixth resistor $R_6$, the value of the power supply voltage is in a range between the minimum value that guarantees a constant output voltage and the maximum voltage value that the chip process may withstand, for example, in this embodiment, the power supply voltage range is set to 2.4V to 5.5V). The temperature coefficient generated by constant current and the temperature coefficient of the infrared light emitting diode are partially offset, so that the infrared light emitting diode may generate infrared light with constant luminous efficiency in the full temperature range, thereby meeting a certain timing sequence requirement, with no standby power consumption when not working, and thereby reducing unnecessary power consumption.

Meanwhile, since the MOS transistors used in this technical solution all adopt standard CMOS technology, no additional photo-etching board is required.

In the constant current driving circuit, turning on and turning off of the linear voltage regulator module may be separately controlled. For some periodically used equipment, electric energy loss may be effectively reduced. The reference voltage source module, the linear voltage regulator module, the level conversion module, the current mirror module and the first NMOS transistor may be integrated into a same chip, so that the constant current driving circuit has a more compact structure and occupied area of PCB is reduced. There is no voltage coefficient within a certain power supply voltage range. It may meet a certain timing sequence requirement, and there is no standby power consumption when not working. In the photoelectric smoke alarm circuit including the constant current driving circuit, the temperature coefficient generated by constant current and the temperature coefficient of the infrared light emitting diode are partially offset, so that the current flowing through the infrared light emitting diode remains constant within a certain variation range of power supply voltage, and the luminous intensity of infrared light emitting diodes remains consistent over the full temperature range.

In this specification, the present disclosure has been described with reference to the embodiments. However, it is obvious that various modifications and changes may still be made without departing from the spirit and scope of this disclosure. Therefore, the description and drawings should be regarded as illustrative rather than restrictive.

What is claimed is:

1. A constant current driving circuit, comprising:

a reference voltage source module;

a linear voltage regulator module;

a level conversion module;

a current mirror module; and a first NMOS transistor, wherein an input terminal of the reference voltage source module and a second input terminal of the linear voltage regulator module are each connected with an external power supply;

an output terminal of the reference voltage source module is connected with a first input terminal of the linear voltage regulator module and an input terminal of the level conversion module;

an output terminal of the linear voltage regulator module is connected with a power terminal of the level conversion module and a power terminal of the current mirror module, and then used as an output terminal of the constant current driving circuit;

an output terminal of the level conversion module is connected with an input terminal of the current mirror module; and an output terminal of the current mirror module is connected with a gate electrode of the first NMOS transistor, a source electrode of the first NMOS transistor is grounded, and a drain electrode of the first NMOS transistor is used as an input terminal of the constant current driving circuit.

2. The constant current driving circuit according to claim 1, wherein the external power supply has a constant reference voltage; the output terminal of the constant current driving circuit is connected with a first port of an external load; and the input terminal of the constant current driving circuit is connected with a second port of the load.

3. The constant current driving circuit according to claim 2, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

4. A photoelectric smoke alarm circuit, comprising the constant current driving circuit according to claim 3, wherein the photoelectric smoke alarm circuit further comprises a capacitor and an optical labyrinth module;

the optical labyrinth module comprises an infrared light emitting diode and a photodiode;

the capacitor and the infrared light emitting diode are jointly used as a load;

one terminal of the capacitor and an anode of the infrared light emitting diode are jointly used as a first port of the load and are each connected with the output terminal of the constant current driving circuit;

the other terminal of the capacitor is grounded;

a cathode of the infrared light emitting diode is used as a second port of the load and is connected with the drain electrode of the first NMOS transistor; and the photodiode is driven by the infrared light emitting diode to work.

5. The constant current driving circuit according to claim 1, wherein the reference voltage source module comprises a first PMOS transistor, a first resistor, a second resistor, a third resistor, a fourth resistor, a first triode, a second triode and a first amplifier, wherein the third resistor is an adjustable resistor;

a source electrode of the first PMOS transistor is used as the input terminal of the reference voltage source module and is connected with the external power supply; and a drain electrode of the first PMOS transistor is connected with a first terminal of the third resistor;

a second terminal of the third resistor is connected with the second resistor and the fourth resistor;

the second resistor is connected in series with the first resistor and then connected with an emitting electrode of the first triode;

a base electrode and a collector electrode of the first triode are each grounded;

the fourth resistor is connected with an emitting electrode of the second triode;

a base electrode and a collector electrode of the second triode are each grounded;

a non-inverting input terminal of the first amplifier is connected between the second resistor and the first resistor, an inverting input terminal of the first amplifier is connected between the fourth resistor and the emitting electrode of the second triode, and an output terminal of the first amplifier is connected with a gate electrode of the first PMOS transistor; and an adjustable terminal of the third resistor is used as the output terminal of the reference voltage source module, and is connected with the first input terminal of the linear voltage regulator module and the input terminal of the level conversion module.

6. The constant current driving circuit according to claim 5, wherein the reference voltage source module is configured to cause a voltage at the non-inverting input terminal of the first amplifier to be equal to a voltage at the inverting input terminal of the first amplifier in a manner of negative feedback, and a $V_{BE}$ difference between the first triode and the second triode is divided by a resistance value of the first resistor to obtain a Proportional to Absolute Temperature (PTAT) current.

7. The constant current driving circuit according to claim 5, wherein the fourth resistor is a thermistor.

8. The constant current driving circuit according to claim 5, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

9. A photoelectric smoke alarm circuit, comprising the constant current driving circuit according to claim 8, wherein the photoelectric smoke alarm circuit further comprises a capacitor and an optical labyrinth module;

the optical labyrinth module comprises an infrared light emitting diode and a photodiode;

the capacitor and the infrared light emitting diode are jointly used as a load;

one terminal of the capacitor and an anode of the infrared light emitting diode are jointly used as a first port of the load and are each connected with the output terminal of the constant current driving circuit;

the other terminal of the capacitor is grounded;

a cathode of the infrared light emitting diode is used as a second port of the load and is connected with the drain electrode of the first NMOS transistor; and the photodiode is driven by the infrared light emitting diode to work.

10. The constant current driving circuit according to claim 1, wherein the linear voltage regulator module comprises a second amplifier, a second PMOS transistor, a fifth resistor, and a sixth resistor;

an inverting input terminal of the second amplifier is used as a first input terminal of the linear voltage regulator module and is connected with the output terminal of the reference voltage source module; and an output terminal of the second amplifier is connected with a gate electrode of the second PMOS transistor;

a source electrode of the second PMOS transistor is used as a second input terminal of the linear voltage regulator module and is connected with the external power supply; a drain electrode of the second PMOS transistor is connected with one terminal of the fifth resistor, the other terminal of the fifth resistor is connected with one terminal of the sixth resistor, and the other terminal of the sixth resistor is grounded;

a non-inverting input terminal of the second amplifier is connected between the fifth resistor and the sixth resistor; and a drain electrode of the second PMOS transistor is used as the output terminal of the linear voltage regulator module and is connected with the power terminal of the level conversion module and the power terminal of the current mirror module.

11. The constant current driving circuit according to claim 10, wherein the linear voltage regulator module is configured to use a constant band gap reference voltage provided by the reference voltage source module to obtain a constant voltage with band load capacity through a negative feedback of the second amplifier, the second PMOS transistor, the fifth resistor and the sixth resistor, for normal operation of the level conversion module and the current mirror module.

12. The constant current driving circuit according to claim 10, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

13. The constant current driving circuit according to claim 1, wherein the level conversion module comprises a third amplifier, a third PMOS transistor and a seventh resistor;

an inverting input terminal of the third amplifier is used as the input terminal of the level conversion module and is connected with the output terminal of the reference voltage source module; an output terminal of the third amplifier is connected with a gate electrode of the third PMOS transistor; a drain electrode of the third PMOS transistor is connected with one terminal of the seventh resistor, and the other terminal of the seventh resistor is grounded;

a non-inverting input terminal of the third amplifier is connected between the drain electrode of the third PMOS transistor and the seventh resistor;

a power terminal of the third amplifier and a source electrode of the third PMOS transistor are jointly used as the power terminal of the level conversion module and are connected with the output terminal of the linear voltage regulator module; and a gate electrode of the third PMOS transistor is used as the output terminal of the level conversion module and is connected with the input terminal of the current mirror module.

14. The constant current driving circuit according to claim 13, wherein a bias of the current mirror module is connected with the output terminal of the third amplifier of the level conversion module.

15. The constant current driving circuit according to claim 13, wherein the level conversion module is configured to convert a band gap reference voltage output by the reference voltage source module into a bias voltage matching the current mirror module, and a temperature coefficient of the bias voltage is associated with a temperature coefficient of the band gap reference voltage.

16. The constant current driving circuit according to claim 13, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

17. The constant current driving circuit according to claim 1, wherein the current mirror module comprises a fourth PMOS transistor, a fifth PMOS transistor, a sixth PMOS transistor, a second NMOS transistor, a third NMOS transistor, a fourth NMOS transistor, a fifth NMOS transistor and a sixth NMOS transistor;

a gate electrode of the fourth PMOS transistor is used as the input terminal of the current mirror module and is connected with the output terminal of the level conversion module;

a source electrode of the fourth PMOS transistor, a source electrode of the fifth PMOS transistor and a source electrode of the sixth PMOS transistor are jointly used as the power terminal of the current mirror module and are each connected with the output terminal of the linear voltage regulator module;

a drain electrode of the fourth PMOS transistor is connected with a drain electrode of the second NMOS transistor; a source electrode of the second NMOS transistor is connected with a drain electrode of the fourth NMOS transistor, a gate electrode of the fourth NMOS transistor and a gate electrode of the fifth NMOS transistor;

a drain electrode of the fifth PMOS transistor is connected with a drain electrode of the third NMOS transistor; a source electrode of the third NMOS transistor is connected with a drain electrode of the fifth NMOS transistor; a gate electrode of the fifth PMOS transistor is connected with the drain electrode of the fifth PMOS transistor and a gate electrode of the sixth PMOS transistor;

a drain electrode of the sixth PMOS transistor is connected with a drain electrode of the sixth NMOS transistor and a gate electrode of the sixth NMOS transistor;

a gate electrode of the second NMOS transistor and a gate electrode of the third NMOS transistor are each connected with an enable signal;

a source electrode of the fourth NMOS transistor, a source electrode of the fifth NMOS transistor and a source electrode of the sixth NMOS transistor are each grounded; and a gate electrode of the sixth NMOS is used as the output terminal of the current mirror module and is connected with the gate electrode of the first NMOS transistor.

18. The constant current driving circuit according to claim 17, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

19. The constant current driving circuit according to claim 1, wherein the reference voltage source module, the linear voltage regulator module, the level conversion module, the current mirror module and the first NMOS transistor are integrated into a chip, the input terminal of the reference voltage source module and the second input terminal of the linear voltage regulator module are jointly used as a power terminal of the chip, and the source electrode of the first NMOS transistor is used as a ground terminal of the chip; the output terminal of the linear voltage regulator module, the power terminal of the level conversion module and the power terminal of the current mirror module are jointly connected to be used as an output terminal of the chip, and the drain electrode of the first NMOS transistor is used as an input terminal of the chip.

20. A photoelectric smoke alarm circuit, comprising the constant current driving circuit according to claim 19, wherein the photoelectric smoke alarm circuit further comprises a capacitor and an optical labyrinth module;

the optical labyrinth module comprises an infrared light emitting diode and a photodiode;

the capacitor and the infrared light emitting diode are jointly used as a load;

one terminal of the capacitor and an anode of the infrared light emitting diode are jointly used as a first port of the load and are each connected with the output terminal of the constant current driving circuit;

the other terminal of the capacitor is grounded;

a cathode of the infrared light emitting diode is used as a second port of the load and is connected with the drain electrode of the first NMOS transistor; and the photodiode is driven by the infrared light emitting diode to work.

* * * * *